US009959686B2

(12) United States Patent
Smith et al.

(10) Patent No.: US 9,959,686 B2
(45) Date of Patent: May 1, 2018

(54) OPERATION ANALYSIS SYSTEM FOR A MACHINE

(71) Applicant: Caterpillar Inc., Peoria, IL (US)

(72) Inventors: Vernon R. Smith, Mossville, IL (US); James G. Katter, Jr., Dunlap, IL (US); Vishnu Sugnath Prabhakaran, Chennai (IN)

(73) Assignee: Caterpillar Inc., Peoria, IL (US)

( * ) Notice: Subject to any disclaimer, the term of this patent is extended or adjusted under 35 U.S.C. 154(b) by 150 days.

(21) Appl. No.: 15/050,553

(22) Filed: Feb. 23, 2016

(65) Prior Publication Data

US 2017/0243409 A1 Aug. 24, 2017

(51) Int. Cl.

| | |
|---|---|
| ***G07C 5/00*** | (2006.01) |
| ***G07C 5/08*** | (2006.01) |
| *G07C 5/12* | (2006.01) |

(52) U.S. Cl.

CPC ..... *G07C 5/008* (2013.01); *G07C 5/0825* (2013.01); *G07C 5/0841* (2013.01)

(58) Field of Classification Search

CPC .... G07C 5/008; G07C 5/0825; G07C 5/0841; G05B 19/0421; B60R 16/023; G06F 9/44505; G06F 8/60

See application file for complete search history.

(56) References Cited

U.S. PATENT DOCUMENTS

| | | | | |
|---|---|---|---|---|
| 6,609,051 | B2 | 8/2003 | Fiechter et al. | |
| 6,850,823 | B2 | 2/2005 | Eun et al. | |
| 8,473,143 | B2 | 6/2013 | Stark et al. | |
| 2009/0172014 | A1* | 7/2009 | Huetter | G06F 17/30551 |
| 2009/0271151 | A1* | 10/2009 | O'Neal | H03M 7/30 702/182 |
| 2011/0258044 | A1 | 6/2011 | Kargupta | |
| 2013/0104064 | A1* | 4/2013 | McCormick | G06F 3/0484 715/765 |
| 2016/0117868 | A1* | 4/2016 | Mitchell | B60R 16/023 701/32.3 |
| 2016/0223813 | A1* | 8/2016 | Feldman | G02B 27/01 |
| 2017/0154478 | A1* | 6/2017 | Mitchell | B60R 16/023 |

FOREIGN PATENT DOCUMENTS

| | | | | |
|---|---|---|---|---|
| WO | WO-2007038983 | A1 * | 4/2007 | G07C 5/0808 |
| WO | WO 2014/045395 | A1 | 3/2014 | |

* cited by examiner

*Primary Examiner* — Dale Moyer
(74) *Attorney, Agent, or Firm* — Finnegan, Henderson, Farabow, Garrett & Dunner, LLP; Edward Y. Lin

(57) ABSTRACT

Systems and methods are disclosed for analyzing operation of a machine. The system includes a memory device configured to store a data stream that includes values of a plurality of parameters. The system further includes a data interface configured to receive a first script associated with a first set of parameters selected from the plurality of parameters, and a second script associated with a second set of parameters selected from the plurality of parameters. A processing device is in communication with the memory device and the data interface. The processing device is configured to analyze the data stream according to the first and second scripts to produce a first result associated with the first set of parameters and a second result associated with the second set of parameters. The processing device is further configured to render for display the first result and the second result.

19 Claims, 3 Drawing Sheets

OPERATION ANALYSIS SYSTEM FOR A MACHINE

TECHNICAL FIELD

This disclosure relates generally to an analysis system and, more particularly, to systems and methods for analyzing operation of a machine.

BACKGROUND

An important feature in any modern machine (e.g., commercial vehicles, construction machines, fixed engine systems, marine-based machines, etc.) is the on-board control system. The on-board control system uses processing devices (e.g., microprocessors) to control and monitor operation of the machine. Some on-board control systems include one or more different Electronic Control Modules (ECMs) connected to various software-driven components of the machine. The ECMs can collect real-time information from a plurality of sensors while the machine operates. Based on the collected information, the on-board control system can adjust the operation of at least one software-driven component, or provide an indication regarding the operation of at least one software-driven component.

As performances of the processing devices continue to improve, the potential capabilities of on-board control systems increase. While in the past all the processing resources of the on-board control system were dedicated to monitoring and/or controlling the software-driven components of the machine, today's on-board control systems can do much more. For example, the on-board control system can analyze in real-time information collected from a plurality of sensors and generate high-throughput data streams. The data streams may be analyzed, for example, to determine the health of the machine.

One exemplary method for real-time on-board data analysis is described in U.S. Patent Application Publication No. US 2011/0258044 A1 (the '044 publication) filed by Kargupta on Jun. 30, 2011. The '044 publication describes a system for on-board mining of vehicle data observed through sensors. The patterns and statistical models generated by the on-board system are sent to a remote server for additional mining of the models and storage in databases. The system described in the '044 publication preforms a preliminary analysis of the data retrieved from the sensors, thus avoiding the need for sending the remote server a large amount of raw data.

Although the '044 publication describes a system that better utilizes the processing capacities of the on-board control system, it provides only a partial solution. The '044 publication teaches performing fixed analysis of the data retrieved from the sensors. Yet, there is a need for dynamic analysis of the operation of the machine that studies the real-time data collected from the sensors based on specific requests from an off-board data system.

The system and method of the present disclosure are directed towards overcoming one or more of the problems as set forth above and/or other shortcomings in the art.

SUMMARY

In one aspect, the present disclosure is directed to an analysis system for a machine. The system may include a memory device located on-board the machine and configured to store a data stream that includes values of a plurality of parameters. The system may also include a data interface located on-board the machine and configured to receive a first script associated with a first set of parameters selected from the plurality of parameters, and a second script associated with a second set of parameters selected from the plurality of parameters. The system may further include a processing device located on-board the machine in communication with the memory device and the data interface. The processing device is configured to analyze the data stream according to the first script to produce a first result associated with the first set of parameters, and analyze the data stream according to the second script to produce a second result associated with the second set of parameters. The processing device may be configured to render for display the first result and the second result.

In another aspect, the present disclosure is directed to a method for analyzing operation of a machine. The method may include storing on-board the machine a data stream that includes values of a plurality of parameters. The method may also include receiving on-board the machine a first script associated with a first set of parameters selected from the plurality of parameters and a second script associated with a second set of parameters selected from the plurality of parameters. The method may further include analyzing on-board the machine the data stream according to the first script to produce a first result associated with the first set of parameters, and analyzing on-board the machine the data stream according to the second script to produce a second result associated with the second set of parameters. The method may further include rendering for display the first result and the second result.

In yet another aspect, the present disclosure is directed to a computer programmable medium having executable instructions stored thereon for completing a method for analyzing operation of a machine The method may include storing on-board the machine a data stream that includes values of a plurality of parameters. The method may also include receiving on-board the machine a first script associated with a first set of parameters selected from the plurality of parameters and a second script associated with a second set of parameters selected from the plurality of parameters. The method may further include analyzing on-board the machine the data stream according to the first script to produce a first result associated with the first set of parameters, and analyzing on-board the machine the data stream according to the second script to produce a second result associated with the second set of parameters. The method may further include rendering for display the first result and the second result.

DETAILED DESCRIPTION

Figure 1:
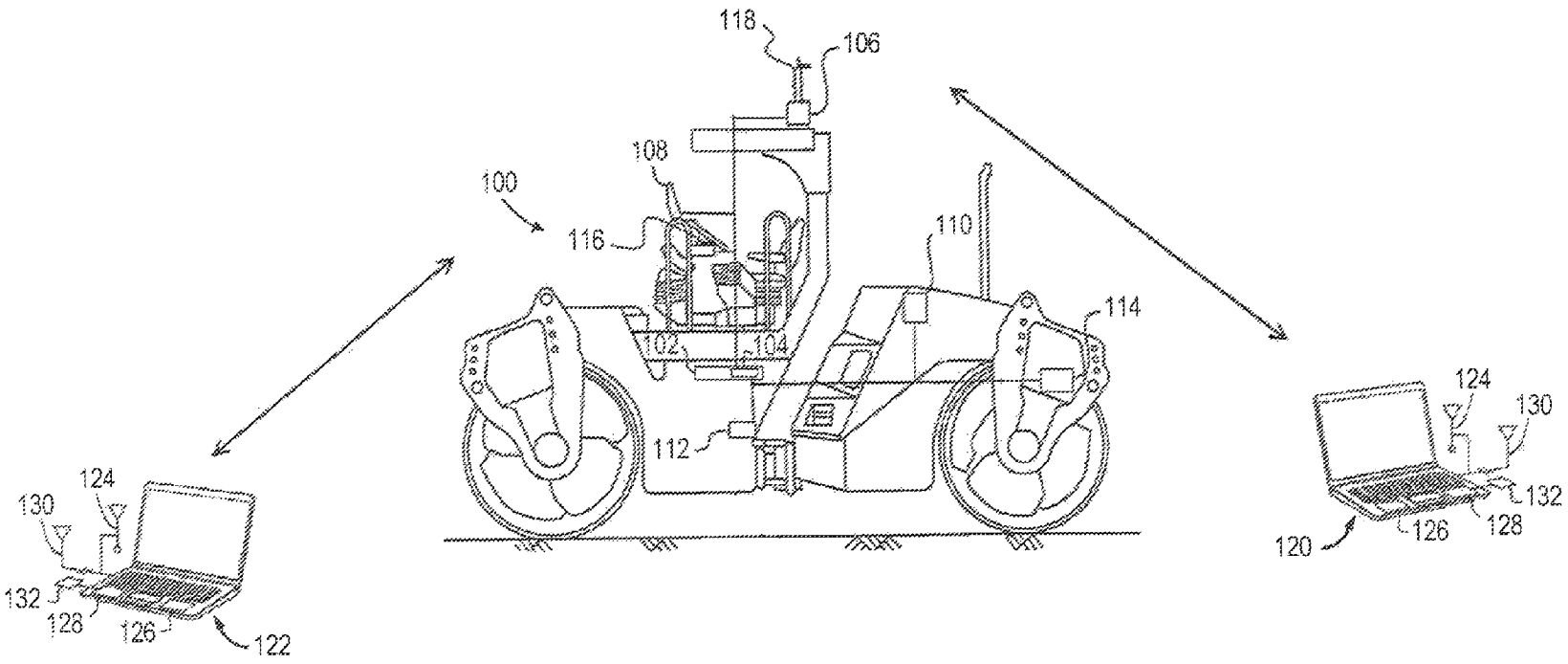
FIG. 1 is a diagrammatic side view illustration of an exemplary machine consistent with the disclosed embodiments.

FIG. 1 schematically illustrates an exemplary machine 100 consistent with the disclosed embodiments. In the example depicted in FIG. 1, machine 100 is a compactor. It is contemplated, however, that machine 100 may embody other types of machines known in the art. For example, machine 100 may alternatively embody an earth moving machine, a passenger vehicle, a stationary generator set, a pumping mechanism, or any other machine.

Machine 100 includes an on-board control system 102 (hereinafter referred to as "system 102"). In some embodiments, system 102 may be part of an autonomous machine control system. In other embodiments, system 102 may control and/or monitor a plurality of software-driven components that facilitate the operation of machine 100. For the purposes of this disclosure, a software-driven component may be considered any component or device that utilizes software in its operation. System 102 may communicate directly or indirectly with the plurality of software-driven components using a data interface 104. The term "data interface" includes any device configured to receive digital data from one or more sources. The disclosed embodiments are not limited to any particular data interface configurations or protocol.

The plurality of software-driven components included in machine 100 may be auxiliary components, such as a locating device 106 used to geographically locate machine 100, or a display device 108 used to present information to an operator of machine 100. In addition, the plurality of software-driven components included in machine 100 may be more fundamental components, such as an engine 110, a throttling system 112, a braking system 114, and a steering system 116. Other types of components not named herein may also be included on the machine 100, and may communicate with one another and with data interface 104. While other components are not explicitly named, it is to be understood that such components may be controlled and/or monitored by system 102.

As shown in FIG. 1, data interface 104 may be operatively connected with an antenna 118 for communicating with a first off-board data system 120 and with a second off-board data system 122. System 102 may use antenna 118 to wirelessly transmit and receive information, such as, data and user instructions. The wireless communications may include satellite, cellular, Wireless Local Area Network (WLAN), infrared, and any other type of wireless communications that enables data interface 104 to exchange information with off-board data systems 120 and 122. Alternatively, system 102 may include hardware and/or software that enables sending and receiving of information through a direct data link (not shown) to off-board data systems 120 and 122.

In some embodiments, off-board data systems 120 and 122 may belong to a business entity associated with machine 100, such as a worksite operator, manufacturer, dealer, retailer, owner, service provider, or any other entity that generates, maintains, sends, and/or receives information associated with machine 100. To this end, off-board data systems 120 and 122 may include a receiver 124, a processor 126, a memory 128 and a transmitter 130. In addition, off-board data systems 120 and 122 may also include a memory writing device 132 configured to record electronic data from machine 100. In some examples, off-board data systems 120 and 122 may include, a laptop, a work station, a mobile computing device, a mainframe, and other computing systems known in the art.

Figure 2:
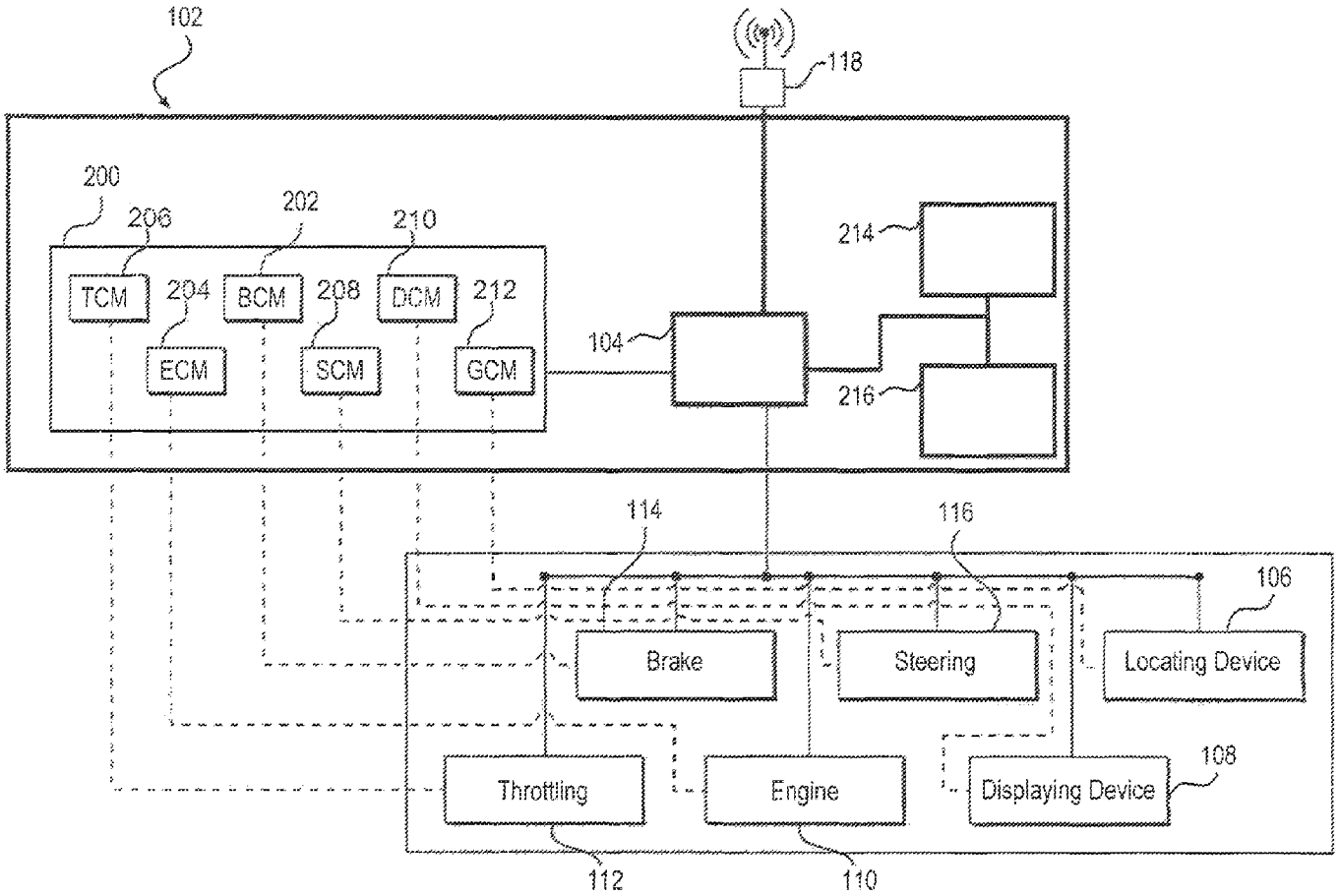
FIG. 2 is a diagrammatic illustration of an exemplary on-board control system that may be used in conjunction with the machine of FIG. 1.

FIG. 2 illustrates an exemplary on-board control system 102 that may be used in conjunction with the machine 100. As shown in FIG. 2, system 102 may include or communicate with one or more control modules 200, which are operatively connected to one (or more) software-driven components. For example, a Brake Control Module (BCM) 202 is connected to braking system 114 and together function as a brake control system that can work in conjunction with system 102. Other control modules 200 may include Engine Control Module (ECM) 204 connected to engine 110, Throttling Control Module (TCM) 206 connected to throttling system 112, Steering Control Module (SCM) 208 connected to steering system 116, Displaying Control Module (DCM) 210 connected to display device 108, and a General Control Module (GCM) 212 connected to locating device 106. Control modules 200 may communicate with each other and/or communicate with other components of system 102. In addition, each of control modules 200 may include any device or component for controlling, monitoring, recording, storing, indexing, processing, and/or communicating the operational aspects of machine 100.

In some embodiments, system 102 may include a memory device 214 located on-board machine 100 and configured to store real-time information collected from the software-driven components. The term "memory device" may include any suitable storage medium for storing digital data or program code. For example, RAM, ROM, flash memory, a hard drive, etc. The real-time information collected from the software-driven components may include any details related to the operation and function of the software-driven components. In addition, memory device 214 may be configured to store supplemental information, such as software version, hardware version, operational status, component wear, component safety, and/or any other non-real-time details related to the software-driven components.

In some embodiments, system 102 may include a processing device 216 also located on-board machine 100 in communication with memory device 214 and data interface 104. The term "processing device" may include any physical device having an electric circuit that performs a logic operation on input. For example, the processing device 216 may include one or more integrated circuits, microchips, microcontrollers, microprocessors, all or part of a central processing unit (CPU), graphics processing unit (GPU), digital signal processor (DSP), field programmable gate array (FPGA), or other circuits suitable for executing instructions or performing logic operations. In some embodiments, processing device 216 may be associated with a software product stored on a non-transitory computer readable medium, e.g., memory device 214, and comprising data and computer implementable instructions. The instructions, when executed by processing device 216, cause processing device 216 to perform operations. For example, the operations may include analyzing at least part of a data stream representing the operation of machine 100.

As shown in FIG. 2, processing device 216 may be operatively connected with antenna 118 for communicating with one or more of off-board data systems 120 and 122. In one embodiment, data interface 104 may be configured to receive a first script and a second script from off-board data system 120 and/or off-board data system 122. The term "script" may include a routine or an algorithm representing at least one query or request to analyze real-time information collected from the software-driven components according to a selected number of parameters. In one example, the script can be remotely designed and/or updated at any time to include a series of queries requesting information from machine 100. The script may include, for example, software, firmware, code, portions of code, data compilations, and/or a combination of these or any other type of data. In some cases, the script may include, for example, an HTML-based script, an IVR-based script, an XML-based script, or a combination of these or other scripting formats. Processing device 216 may analyze information stored on memory device 214 according to the first script and the second script to produce corresponding results. A detailed explanation of the process of analyzing the data streams according to the received first and second scripts is provided below with reference to FIG. 3.

INDUSTRIAL APPLICABILITY

The disclosed systems and methods may provide an accurate and reliable way for on-board analysis of an operation of machine 100. Specifically, the disclosed systems and methods may provide multiple users of off-board data systems real-time answers to various queries. This capability can improve uptime of machine 100 through predictive failure alerts and improve productivity by reducing fuel costs through enhanced operator training and performance feedback.

In addition, the disclosed systems and methods may be used to improve product design through detailed product usage feedback. For example, as part of the development cycle, manufacturers usually perform detailed failure analyses to identify failure modes that can lead to undesired conditions or driver annoyance. In addition, extensive testing and validation activities may be carried out as part of the production part approval process to gain confidence in the hardware and software systems. On-board diagnostics can provide specific data, for example, how each of the software-driven components functions during failure or other scenarios.

Figure 3:
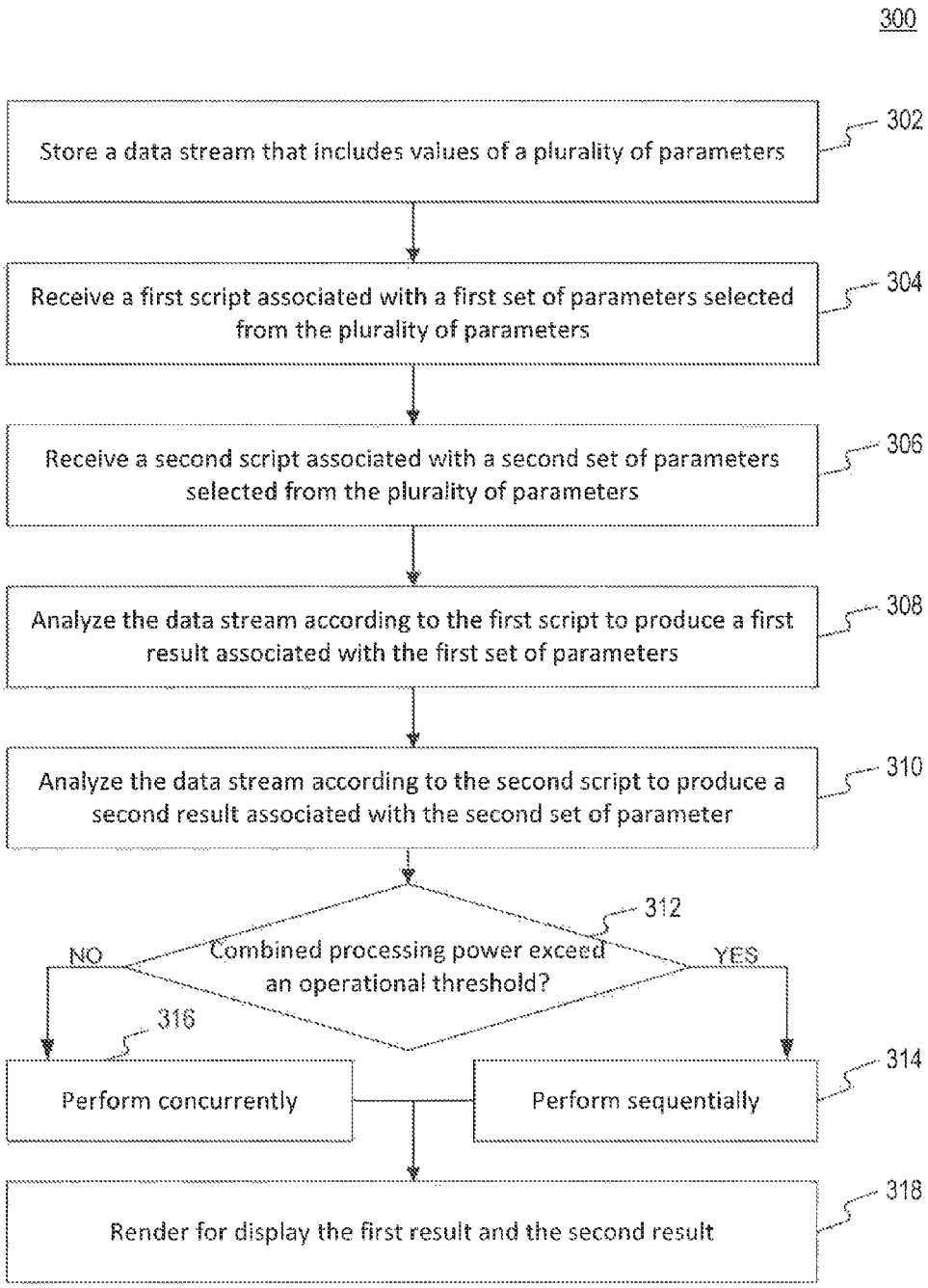
FIG. 3 is a flowchart showing an exemplary process that may be performed by the on-board control system of FIG. 2.

FIG. 3 is a flow chart illustrating an exemplary process 300 for on-board dynamic analysis of an operation of machine 100. Accordingly, all the steps of process 300 may be carried oat on-board machine 100. At step 302, memory device 214 may store a data stream that includes values of a plurality of parameters. In some embodiments, the plurality of parameters may be associated with a plurality of software-driven components. The values of the plurality of parameters may be received from one or more control modules 200, or directly from the software-driven components. For example, the data stream may include values of the following parameters associated with braking system 114: longitudinal acceleration, lateral acceleration, brake fluid level, brake pedal position, brake pressure, delivered torque, steering column position, system voltage, traction control system, system relay feedback, and more. The values of the parameters may be generated by control modules 200 or by the software-driven components themselves. One skilled in the art will appreciate that the data stream may include values of several groups of parameters, and each group of parameters may be associated with a different software-driven component. In some embodiments, memory device 214 may be further configured to store a plurality of data streams at a defined rate, each data stream may include values of parameters collected at different times. For example, memory device 214 may store a data stream every second, every minute, or every hour. In other embodiments, the memory device may include a circular buffer, such that when memory device 214 is nearly full, the oldest data streams may be deleted to make space for newer data streams.

At step 304, data interface 104 may receive a first script associated with a first set of parameters selected from the plurality of parameters. In one example, the first script may represent a query or a request to analyze information collected from engine 110 and braking system 114. The first set of parameters may include all or part of the parameters associated with engine 110 and braking system 114. In a simplified example, the first set of parameters may include the parameter "revolutions per minute" associated with engine 110 and the parameter "brake pedal position" associated with braking system 114. Accordingly, the first script may, for example, represent a request to identify the engine's Revolutions Per Minute (RPM) every time the brake pedal is applied.

At step 306, data interface 104 may receive a second script associated with a second set of parameters selected from the plurality of parameters. The second script may differ from the first script in several aspects. In one aspect, the first and second scripts may be received from different sources. For example, the first script may be received from first off-board data system 120, while the second script may be received from second off-board data system 122. In another example, the first script may be received from first off-board data system 120, while the second script may be received from an operator of machine 100. Alternatively, both the first and second scripts may be received from a single source, e.g., first off-board data system 120 or the operator of machine 100. As mentioned above, in some embodiments, the data stream may include values of a plurality of parameters associated with the plurality of software-driven components. According to another aspect, the first script may be associated with a first set of parameters for software-driven components that are different than the software-driven components associated with the second set of parameters of the second script. For example, the first script may represent a query to analyze information collected from engine 110 and braking system 114, whereas, the second script may represent a query to analyze information collected from engine 110, steering system 116, and throttling system 112. In addition, the first set of parameters may include a different number of parameters than the second set of parameters.

At step 308, processing device 216 may analyze the data stream according to the first script to produce a first result associated with the first set of parameters. In some embodiments, analyzing the data stream according to the first script may include retrieving from the data stream values of the first set of parameters. Further to the simplified example above, assuming the first set of parameters includes the parameters "revolutions per minute" and "brake pedal position sensor," processing device 216 may be configured to retrieve only the values of these two parameters from the data stream. Thereafter, processing device 216 may analyze the retrieved values of the first set of parameters to produce a first result. The term "result" includes any item of information which may be retrieved in response to an on-board analysis of at least part of the data stream according to a query represented by a script.

At step 310, processing device 216 may analyze the data stream according to the second script to produce a second result associated with the second set of parameters. The second result may be different from the first result in several aspects. In one aspect, the first and second results may include different types of information. For example, the first result may include a "Yes" or "No" answer, whereas the second result may include a complex data matrix. In addition, the first result may include a one-time type of answer, whereas the second result may include a continuous answer. In another aspect, the first and second results may be presented to different entities. For example, the first result may be presented to the operator of machine 100, whereas the second result may be transmitted to first off-board data system 120. The results may be presented without being necessarily dependent on the source that sent the script. For example, the result of a script sent by first off board data system 120 may be presented to the operator on machine 100. In some embodiments, processing device 216 may be configured to concurrently analyze the data stream according to the first and second scripts. The term "concurrently" refers to two (or more) processing operations that occur during coincident or overlapping time periods, either where one begins and ends during the duration of the other or where a later one starts before the completion of the other. In the alternative, processing device 216 may be configured to sequentially analyze the data stream according to the first and second scripts.

At optional step 312, processing device 216 may compare a combined processing power associated with analyzing the data stream according to the first script and second script to an operational threshold, and select to analyze the data stream according to the first and second scripts sequentially or concurrently based on the comparison. For example, if the combined processing power exceeds the operational threshold (YES), in step 314 the processing device 216 may analyze the data stream according to the first script and second script sequentially. Whereas, if the combined processing power does not exceed the operational threshold (NO), in step 316 the processing device 216 may analyze the data stream according to the first script and second script concurrently. In addition to analyze the data stream according to the first and second scripts, processing device 216 may control several operations of the software-driven components. When processing device 216 concurrently analyzes the data stream according to the first and second scripts, there might be a risk of system overload. The system overload could harm the control of the operations of the software-driven components. Therefore, processing device 216 is further configured to ensure that the combined processing power does not exceed an operational threshold. The operational threshold may be determined such that processing device 216 may control the operations of the software-driven components. In some embodiments, the value of the operational threshold may depend on the current operations of machine 100. For example, when machine 100 rests, processing device 216 may be able to execute multiple analysis concurrently. But when machine 100 is working, processing device 216 may only be able to execute multiple analysis sequentially. In some embodiments, processing device 216 may compare a predicted combined processing power associated with analyzing the data stream according to the first script and second script to the operational threshold, and select to analyze the data stream according to the first and second scripts sequentially or concurrently based on comparison.

At step 318, processing device 216 may render for display the first result and the second result. As mentioned above the first and second results may be presented to different entities. For example, the first result may be displayed to first off-board data system 120 and the second result may be displayed to second off-board data system 122. Accordingly, rendering for display the first result may include sending the first result to first off-board data system 120, while rendering for display the second result may include sending the second result to second off-board data system 122. In one embodiment, processing device 216 is configured to render at least one of the first and second results for display on display device 108. And in another embodiment, processing device 216 is configured to render at least one of the first and second results for display on first off-board data system 120. In addition, rendering at least one of the first and second results may include using at least one predefined presentation of data. For example, the first and second results may be presented in standard engineering data types, such as, histograms, trends, totals, time periods/cycles, etc.

Although process 300 describes the on-board analysis according to two scripts, a person skilled in the art will understand that processing device 216 may concurrently or sequentially analyze more than two scripts. As described above, each of the scripts may be different from the other. In addition, it will be apparent to those skilled in the art that various modifications and variations can be made to system 102. Other embodiments will be apparent to those skilled in the art from consideration of the specification and practice of the disclosed system. It is intended that the specification and examples be considered as exemplary only, with a true scope being indicated by the following claims and their equivalents.

What is claimed is:

1. An analysis system for a machine, the system comprising:

a memory device located on-board the machine and configured to store a data stream that includes values of a plurality of parameters;

a data interface located on-board the machine and configured to receive a first script associated with a first set of parameters selected from the plurality of parameters, and a second script associated with a second set of parameters selected from the plurality of parameters; and a processing device located on-board the machine in communication with the memory device and the data interface, wherein the processing device is configured to:

compare a combined processing power associated with analyzing the data stream according to the first script and second script to an operational threshold, and to select analyzing the data stream according to the first and second scripts sequentially or concurrently based on the comparison;

analyze the data stream according to the first script to produce a first result associated with the first set of parameters;

analyze the data stream according to the second script to produce a second result associated with the second set of parameters; and render for display the first result and the second result.

2. The system of claim 1, wherein the memory device is further configured to store a plurality of data streams at a defined rate.

3. The system of claim 1, wherein the memory device includes a circular buffer.

4. The system of claim 1, wherein the system further includes an antenna, and the data interface is further configured to:

receive the first script from a first off-board data system; and receive the second script from a second off-board data system.

5. The system of claim 1, wherein the system further includes an antenna, and the data interface is further configured to:

receive the first script from an off-board data system; and receive the second script from an operator of the machine.

6. The system of claim 1, wherein the system further includes an antenna, and the processing device is further configured to:

communicate a rendering of at least one of the first result and second result for display on an off-board data system.

7. The system of claim 1, wherein:

the plurality of parameters are associated with software-driven components; and the first set of parameters include parameters associated with software-driven components that are different than software-driven components associated with the second set of parameters.

8. The system of claim 1, wherein the first set of parameters include a different number of parameters than the second set of parameters.

9. The system of claim 1, wherein the processing device is configured to analyze the data stream according to the first script by retrieving from the data stream values of the first set of parameters.

10. The system of claim 1, wherein the processing device is configured to render at least one of the first result and second result by using at least one predefined presentation of data.

11. The system of claim 1, wherein:

the processing device is also in communication with a display device; and the processing device is further configured to communicate a rendering of at least one of the first result and second result to the display device.

12. The system of claim 1, wherein the processing device is further configured to concurrently analyze the data stream according to the first script and second script.

13. The system of claim 1, wherein a value of the operational threshold varies based on current operations of the machine.

14. A method for analyzing operation of a machine, the method comprising:

storing on-board the machine a data stream that includes values of a plurality of parameters;

receiving on-board the machine a first script associated with a first set of parameters selected from the plurality of parameters;

receiving on-board the machine a second script associated with a second set of parameters selected from the plurality of parameters;

comparing a combined processing power associated with concurrently analyzing the data stream according to the first script and second script to an operational threshold, and selecting to analyze the data stream according to the first and second scripts sequentially or concurrently based on the comparison;

analyzing on-board the machine the data stream according to the first script to produce a first result associated with the first set of parameters;

analyzing on-board the machine the data stream according to the second script to produce a second result associated with the second set of parameters; and rendering for display the first result and the second result.

15. The method of claim 14, wherein:

receiving the first script includes receiving the first script from a first off-board data system; and receiving the second script includes receiving the second script from a second off-board data system.

16. The method of claim 14, wherein:

the plurality of parameters are associated with software-driven components; and the first set of parameters include parameters associated with software-driven components that are different than software-driven components associated with the second set of parameters.

17. The method of claim 14, wherein a value of the operational threshold varies based on current operations of the machine.

18. A non-transitory computer programmable medium having executable instructions stored thereon for completing a method for analyzing operation of a machine, the method comprising:

storing a data stream that includes values of a plurality of parameters;

receiving a first script associated with a first set of parameters selected from the plurality of parameters;

receiving a second script associated with a second set of parameters selected from the plurality of parameters;

comparing a combined processing power associated with concurrently analyzing the data stream according to the first script and second script to an operational threshold, and selecting to analyze the data stream according to the first and second scripts sequentially or concurrently based on the comparison;

analyzing the data stream according to the first script to produce a first result associated with the first set of parameters;

analyzing the data stream according to the second script to produce a second result associated with the second set of parameters; and rendering for display the first result and the second result.

19. The non-transitory computer programmable medium of claim 18, wherein a value of the operational threshold varies based on current operations of the machine.

* * * * *